US006091800A

United States Patent [19]

Van Andel et al.

[11] Patent Number: 6,091,800

[45] Date of Patent: Jul. 18, 2000

[54] X-RAY TUBE HAVING A COOLING PROFILE ADAPTED TO THE SHAPE OF THE FOCAL SPOT

[75] Inventors: Maarten A. Van Andel; Maurice J. Lambers; Alphonsius D. Klessens, all of Eindhoven; Johan W. Stolk, Heerlen, all of Netherlands

[73] Assignee: U.S. Philips Corporation, New York, N.Y.

[21] Appl. No.: 09/192,711

[22] Filed: Nov. 16, 1998

[30] Foreign Application Priority Data

Nov. 21, 1997 [EP] European Pat. Off. ..... 97203647

[51] Int. Cl.[7] ..... H01J 35/10

[52] U.S. Cl. ..... 378/141; 378/130

[58] Field of Search ..... 378/141, 130

[56] References Cited

U.S. PATENT DOCUMENTS 4,064,411 12/1977 Iwasaki et al. ..... 378/141

FOREIGN PATENT DOCUMENTS 776208 4/1955 United Kingdom .

*Primary Examiner*—Craig E. Church
*Attorney, Agent, or Firm*—Tony E. Piotrowski

[57] ABSTRACT

A focal spot having an annular shape is often formed on the an (4) of an X-ray tube for analytic purposes. For the cooling of an anode it is known to force the cooling water to impinge on the anode with a flow profile having the same shape as the focal spot. In order to achieve this effect in the case of an annular focal spot, a circular delivery opening (36) is provided. In order to break up the steady boundary layer on the surface to be cooled, the impinging cooling water is forcibly split so as to flow into two directions. This is achieved by making the water flow via a distribution member 30 in which the circular delivery opening 36 is provided and by discharging the water via a discharge opening 40 which is situated within the circular delivery opening 40 and also via a return opening which is defined by the outer surface 42 of the distribution member 30 and the inner side of the discharge tube 16.

6 Claims, 3 Drawing Sheets

X-RAY TUBE HAVING A COOLING PROFILE ADAPTED TO THE SHAPE OF THE FOCAL SPOT

The invention relates to an X-ray tube which includes an anode for producing X-rays by incidence of electrons on one side of the anode, the incident electrons forming a focal spot of given shape on the anode, means for cooling the surface at the other side of the anode by means of a cooling liquid, the cooling liquid being transported to and from the surface to be cooled by means of a supply tube and a discharge tube, said two tubes being arranged so as to be coaxial with one another, the cooling liquid being applied to the surface to be cooled via a delivery opening at the end of the supply tube, the shape of said delivery opening being adapted to the shape of the focal spot, a distribution member which is arranged at the end of the inner one of the two coaxial tubes, is situated within the outer tube and has a surface which faces the surface to be cooled and in which the delivery opening is provided, said surface of the distribution member defining a return opening in conjunction with the outer tube.

An X-ray tube of this kind is known from British patent specification GB 776,208.

Generally speaking, X-rays are generated in an X-ray tube by causing electrons accelerated by a high voltage to land on an anode in the tube. The incident electrons form a spot on the anode which is referred to as the focal spot. Because of the comparatively high energy with which the electrons are incident, the anode is heated and must, therefore, be cooled. It is generally known to conduct cooling water along the rear side (i.e. the side other than that on which the electrons are incident) of the anode for this purpose. The focal spot in the X-ray tube disclosed in the cited patent specification has a rectangular shape. In order to achieve improved heat dissipation, this tube is provided with a set of exit apertures which together constitute a delivery opening; the exit apertures are provided in such a manner that the cooling water flowing to the surface to be cooled has a flow profile whose shape is also rectangular and whose dimensions are approximately the same as those of the focal spot. The shape of the delivery opening of this known X-ray tube is thus adapted to the shape of the focal spot.

It is often desirable to impart a given shape to the focal spot in X-ray tubes for analytic purposes, such as X-ray tubes for diffraction or for X-ray fluorescence. The anode is often arranged near the exit window of the X-ray tube, particularly in the case of X-ray tubes for fluorescence; in order to such arrangement possible, the electron emitting filament is arranged adjacent and around the anode, means being provided for deflecting the electrons so that they are incident on the emission surface of the anode nevertheless. Consequently, such tubes often have a focal spot in the form of a ring. The customary method of supplying and discharging the cooling water could be used for such tubes, i.e. the method utilizing coaxially arranged supply and discharge tubes. The cooling water is then conducted directly along the surface to be cooled, notably along the heat profile of the focal spot. In practice, however, an as high as possible cooling capacity is required since the cooling of the anode constitutes the limiting factor in respect of the maximum X-ray power that can be delivered by the X-ray tube. Evidently, the foregoing could be achieved by increasing the dimensions of the cooling system, and hence of the entire X-ray tube, but such an increase is undesirable for reasons of cost and ease of use.

It is an object of the invention to provide an X-ray tube of the kind set forth in which the cooling capacity is significantly increased without it being necessary to increase the dimensions of the X-ray tube itself.

To this end, the X-ray tube according to the invention is characterized in that the distribution member includes an element which is provided with a first duct which constitutes a connection between the delivery opening and the supply tube, and that said surface of the distribution member is provided with a discharge opening which is situated within the delivery opening and communicates, via a further duct in the element of the distribution member, with the outer surface of the element.

The invention is based on the recognition of the fact that always a more or less stationary boundary layer exists in the case of a flow along a wall (i.e. in this case the surface to be cooled). In order to achieve an as high as possible cooling capacity, it is necessary to make this isolating boundary layer as thin as possible and even to break it down, if possible. This cannot be achieved, or not adequately achieved, by causing the cooling water to flow along the "hot spots", parallel to the surface to be cooled. The steps according to the invention ensure that the cooling water arrives like a jet which is directed approximately perpendicularly to the surface to be cooled. Because the cooling water flows off in two opposite directions (i.e. in the direction of the discharge opening within the delivery opening and also in the direction of the return opening defined by the surface of the distribution member in conjunction with the outer tube), the cooling water jet arriving is abruptly pulled when it strikes the surface to be cooled, so that the boundary layer is "broken open" as if it were. This phenomenon is known as "jet impingement cooling". The cooling capacity is significantly increased in this manner.

In an embodiment of the X-ray tube according to the invention, a reservoir is provided between the first duct and the delivery opening. This step ensures that the speed at which the cooling water arrives is equalized in this reservoir, thus providing more uniform delivery and hence more uniform cooling.

A further embodiment of the X-ray tube according to the invention is provided with a plurality of ducts which constitute a connection between the delivery opening and the supply tube and are symmetrically arranged around the axis of the X-ray tube. The X-ray tube may also be provided with a plurality of ducts which constitute a connection between the discharge opening and the outer surface of the element and are symmetrically arranged around the axis of the X-ray tube. These steps also provide more uniform delivery and cooling.

The invention will be described in detail hereinafter with reference to the Figures in which corresponding reference numerals denote corresponding elements. Therein:

Figure 1:
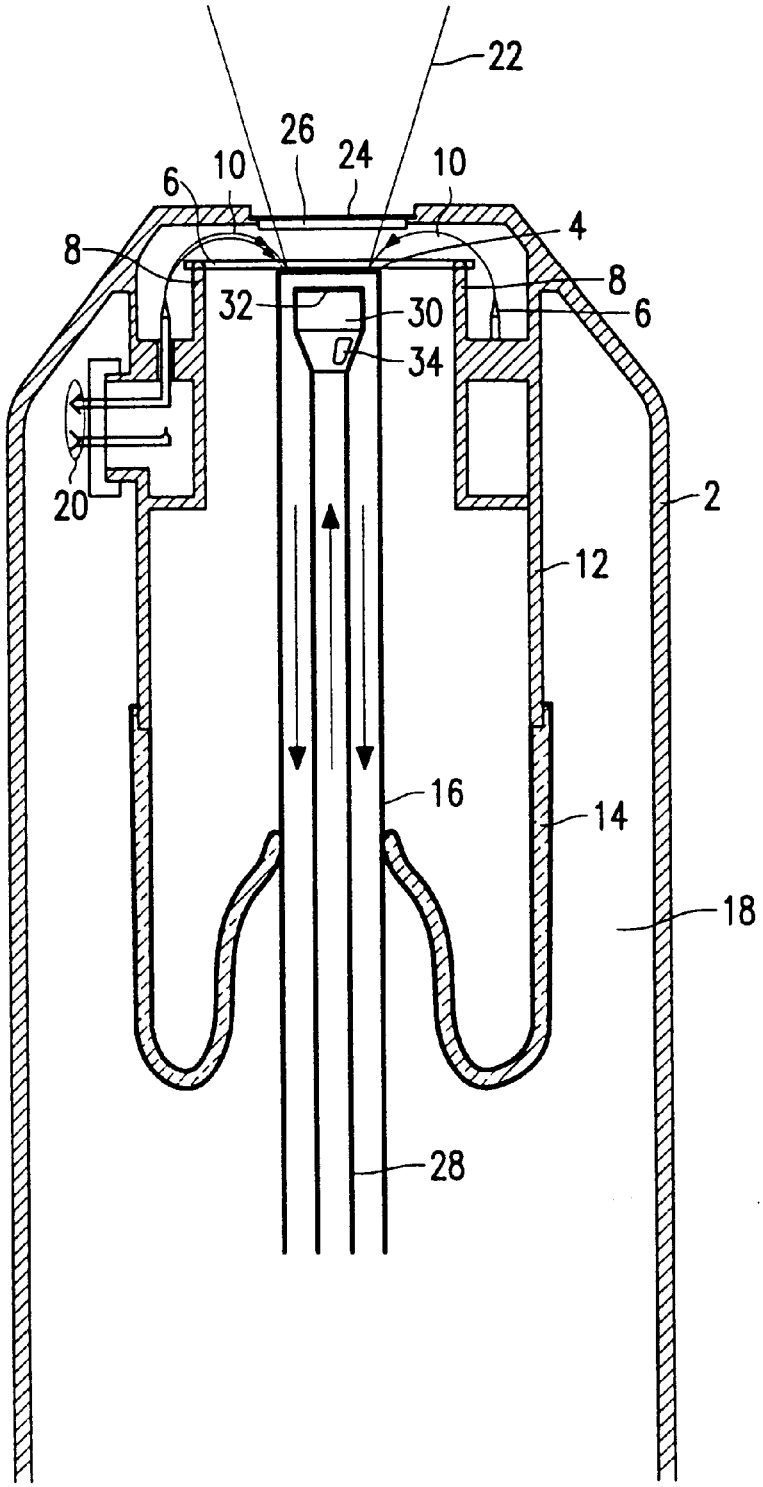
FIG. 1 is a sectional view of an X-ray tube of the end window type for analytic purposes in which the anode is cooled according to the invention.

FIG. 1 shows an X-ray tube according to the invention. The tube is enclosed by an envelope 2 in which an anode 4 is accommodated. The anode 4 is struck by electrons which emanate from a cathode device which consists of a filament wire 6 and a control electrode 8. The electrons emitted by the filament wire 6 are directed onto the anode by the control electrode 8 as represented by the electron beam 10. To this end, the filament 6 is adjusted to a suitable potential relative to the control electrode 8. The control electrode 8 forms part of a supporting construction 12 which is connected to the anode tube 16 via an insulator which is made of glass or a ceramic material. The anode tube 16 is connected to a high voltage source in a manner not shown in the Figure, and is also used for the supply and discharge of cooling water for cooling the anode as denoted by the arrows shown in the anode tube 16. The space 18 around the supporting construction 12 and the insulator 14 is filled with an insulating oil. The filament wire 6 receives a filament current via terminals 20. The filament can also be adjusted to the correct potential, relative to the control electrode 8, via these terminals.

The anode 4 produces X-rays by interception of electrons, which X-rays leave the tube, in the form of an X-ray beam 22, via an X-ray transparent window 24. The X-ray tube is of the so-called end window type in which the anode 4 is arranged as near to the X-ray window 24 as possible. To this end, the filament wire 6 is arranged around the anode 4 and the electrons emanating from the filament wire 6 are deflected to the anode surface by means of the control electrode 8. As a result of this form of electron bombardment, an annular focal spot is formed on the surface of the anode.

The anode tube 16 constitutes, in conjunction with an inner tube 28 which is situated therein and is coaxially arranged with respect thereto, a coaxial system of supply and discharge tubes for the supply and discharge of cooling water for the cooling of the anode, as denoted by the arrows shown therein. At the end of the inner tube 28 there is provided a distribution member 30 which is situated within the outer tube 16 and has a surface 32 which faces the anode surface to be cooled. In conjunction with the inner side of the outer tube 16, the surface 32 of the distribution member defines a return opening for the cooling water. The cooling water also flows back, via an opening (not shown in FIG. 1) which is provided at the center of the surface 32, through ducts in the element of the distribution member 30, and via discharge windows 34, to the outer tube 16 in which this part of the cooling water merges with the cooling water flowing back through the return opening defined by the surface 32 and the inner side of the outer tube 16.

Figure 2:
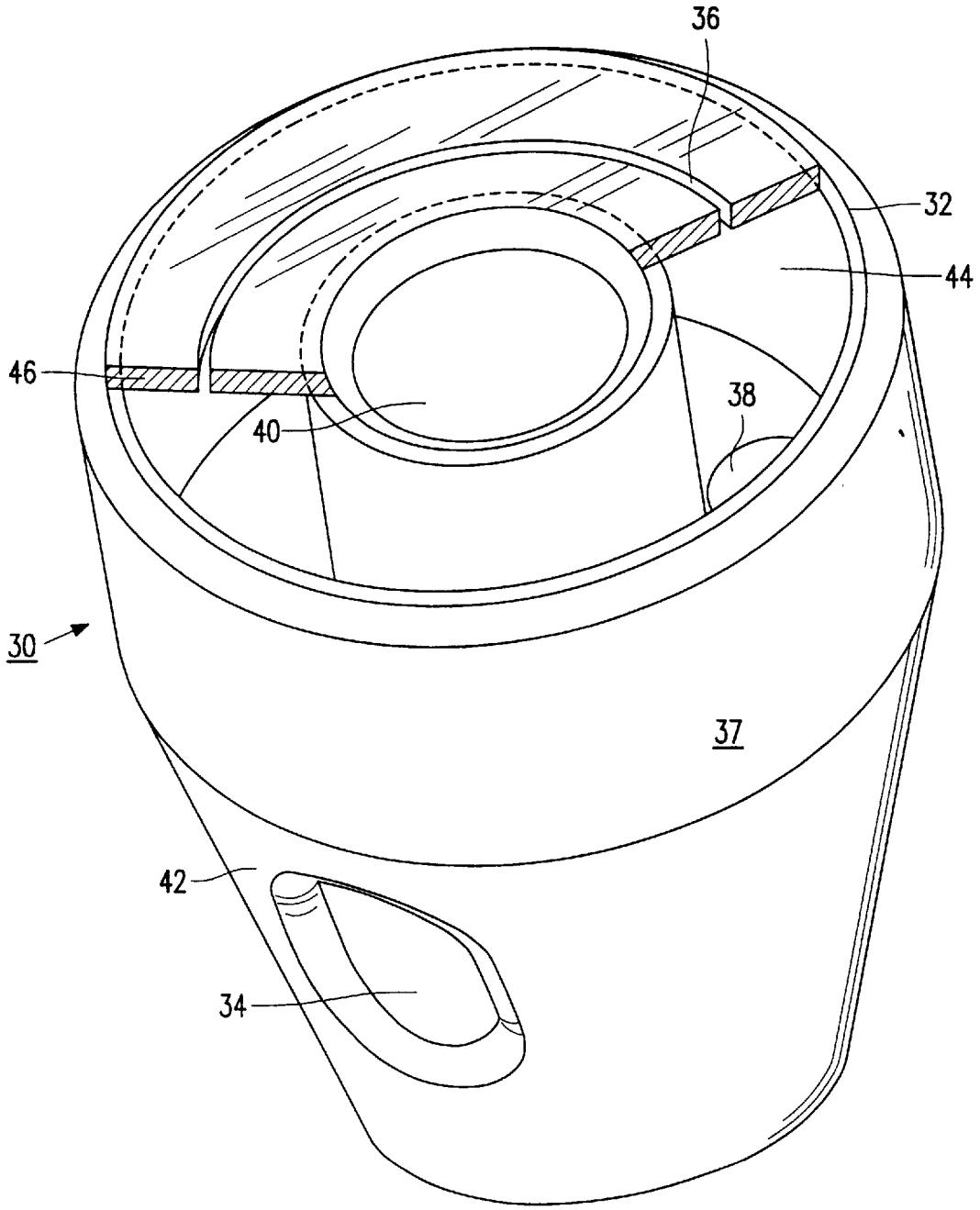
FIG. 2 is a perspective view of a distribution member for the cooling of the anode as shown in FIG. 1.

FIG. 2 is a more detailed perspective view of the distribution member 30 for the cooling of the anode. The distribution member consists of an element 37 in which the various supply and discharge ducts are provided. Via an opening in the lower side (not shown in FIG. 2), the distribution member is connected to the inner tube (the supply tube) 28. From this opening a duct 38 (not completely shown in FIG. 2) extends to a reservoir 44 at the upper side of the element of the distribution member. The opening of this duct is partly visible in FIG. 2. The reservoir 44 is covered by a lid 46 which is shown in a partly broken-away view in FIG. 2. A narrow slit, having a width of the order of magnitude of from 0.1 mm to 1 mm, is provided in the lid 46. This slit acts as a delivery opening for the cooling water. The shape and dimensions of the delivery opening 36 correspond to the shape and dimensions of the annular focal spot. The distance between the surface 32 provided with the delivery opening and the anode surface to be cooled is of the order of magnitude of from zero to 1 mm.

The cooling water supplied via the inner tube 28, the duct 38 and the reservoir 44 impinges, via the delivery opening 36, from the distribution member against the anode surface to be cooled. The outcoming jet, having an annular shape, is split into two sub-flows upon impingement on the surface to be cooled, one sub-flow being discharged along the outer surface 42 of the element 37. As a result of said splitting, the impinging cooling water jet is abruptly pulled apart upon impingement on the surface to be cooled. The desired breaking up of the stationary boundary layer is thus achieved. The other sub-flow is discharged via a discharge opening 40 which is situated within the (circular) delivery opening 36 and communicates with the outer surface of the element via ducts 52 (not shown in FIG. 2) in the element of the distribution member and associated delivery windows 34 in the outer surface. The two sub-flows thus merge again and the returning cooling water is discharged via the outer tube (discharge tube) 16. Because of the presence of the reservoir 44, equalization of the speed and the pressure occurs in the cooling water supplied, so that uniform impingement of the cooling water on the anode is achieved.

Figure 3:
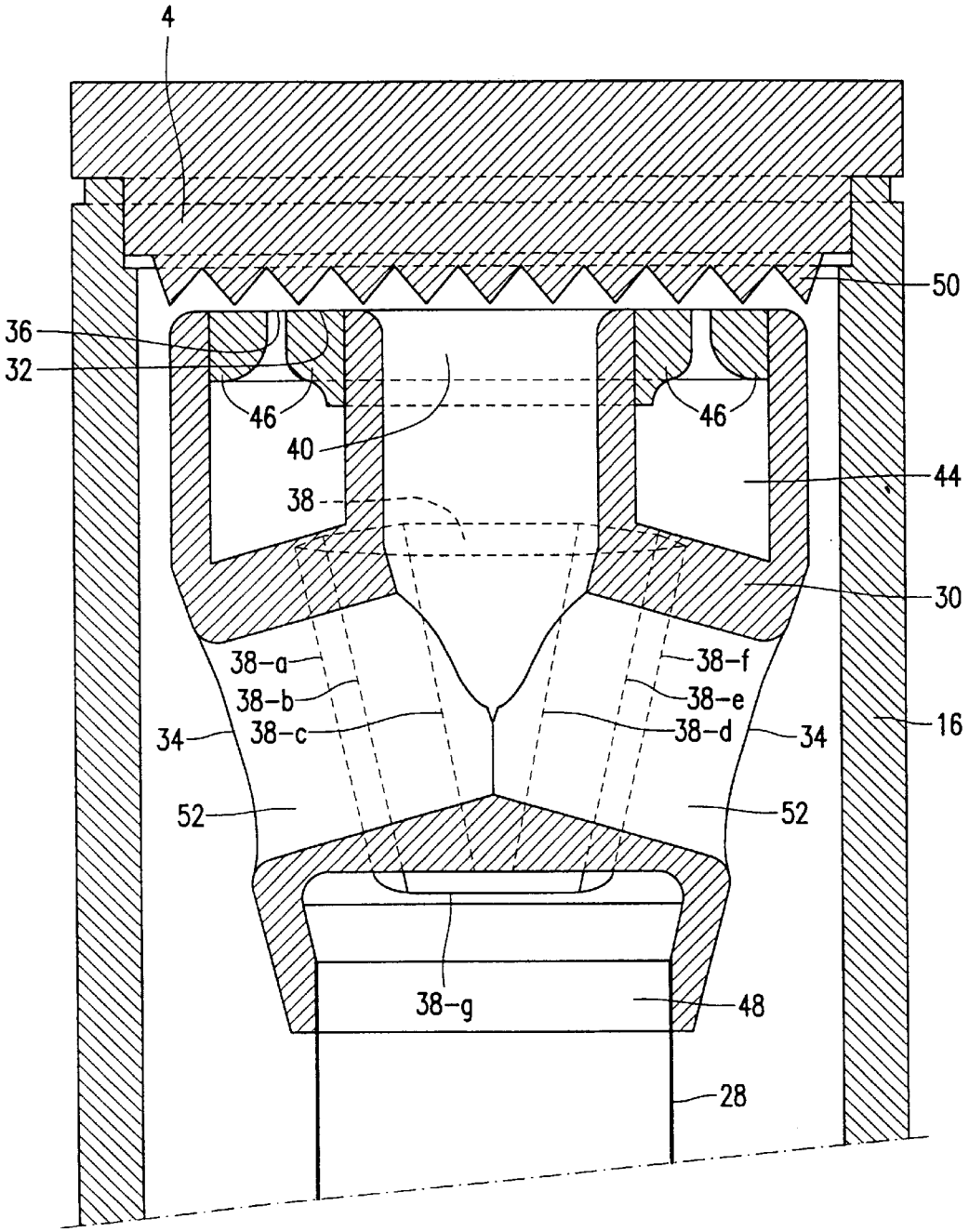
FIG. 3 is a sectional view of the distribution member for the cooling of the anode as shown in FIG. 2.

FIG. 3 is a sectional view of the distribution member for the cooling of the anode shown in FIG. 2. The distribution member is connected to the inner tube 28 (the supply tube) (not shown in FIG. 3) via an opening 48 in the lower side. The surface of the anode 4 to be cooled is provided in known manner with protrusions 50 so as to increase the surface to be cooled and to cause a thorough turbulence in the cooling water across this surface. The reservoir 44 is closed by a lid 46 which is connected to the walls of the reservoir 44 by way of projecting profiles. As has already been described with reference to FIG. 2, the water emerging from the circular delivery opening 36 impinges on the anode surface provided with protrusions and is split into two sub-flows. The distance between the surface 32 of the distribution member and the tips of the projections is between 0 and 1 mm.

Two ducts 38 extend from the opening 48 to the bottom of the reservoir 44. The Figure shows only one duct which is situated above the plane of drawing. The other duct is situated therebelow. Both ducts 38 in this Figure have a hexagonal cross-section whose boundary lines 38-*a* to 38-*f* are shown in the Figure. This cross-section need not be hexagonal; it may also be a cross-section with a smooth boundary. The Figure also shows the lowermost boundary line 38-*g* of the duct. Thus, in this Figure the duct has a cross-section in the form of a flattened cup without a bottom. This duct opens into the bottom of the reservoir 44 by way of an approximately banana-shaped opening, one end of which is shown in FIG. 2. Furthermore, from the discharge opening 40 two channels 52 extend between the ducts 38 to the associated discharge windows 34, the plane of which extends transversely of the plane of drawing in FIG. 3.

What is claimed is:

1. An X-ray tube which includes:

an anode (4) for producing X-rays (22) by incidence of electrons (10) on one side of the anode, the incident electrons forming a focal spot of given shape on the anode, means for cooling the surface at the other side of the anode by means of a cooling liquid, the cooling liquid being transported to and from the surface to be cooled by means of a supply tube (28) and a discharge tube (16), said two tubes being arranged so as to be coaxial with one another, the cooling liquid being applied to the surface to be cooled via a delivery opening (36) at the end of the supply tube, the shape of said delivery opening being adapted to the shape of the focal spot, a distribution member (30) which is arranged at the end of the inner one of the two coaxial tubes, is situated within the outer tube (16), and has a surface (32) which faces the surface to be cooled and in which the delivery opening (36) is provided, said surface (32) of the distribution member defining a return opening in conjunction with the outer tube (16), characterized in that the distribution member (30) includes an element (37) which is provided with a first duct (38) which constitutes a connection between the delivery opening (36) and the supply tube (28), and that said surface of the distribution member is provided with a discharge opening (40) which is situated within the delivery opening (36) and communicates, via a further duct (52) in the element of the distribution member, with the outer surface (42) of the element.

2. An X-ray tube as claimed in claim 1, in which a reservoir (44) is provided between the first duct (38) and the delivery opening (36).

3. An X-ray tube as claimed in claim 1, provided with a plurality of ducts (38) which constitute a connection between the delivery opening (36) and the supply tube (28) and are symmetrically arranged around the axis of the X-ray tube.

4. An X-ray tube as claimed in claim 1, provided with a plurality of ducts (52) which constitute a connection between the discharge opening (40) and the outer surface (42) of the element and are symmetrically arranged around the axis of the X-ray tube.

5. An X-ray tube as claimed in claim 2, provided with a plurality of ducts (38) which constitute a connection between the delivery opening (36) and the supply tube (28) and are symmetrically arranged around the axis of the X-ray tube.

6. An X-ray tube as claimed in claim 2, provided with a plurality of ducts (52) which constitute a connection between the discharge opening (40) and the outer surface (42) of the element and are symmetrically arranged around the axis of the X-ray tube.

* * * * *